US010260331B2

(12) United States Patent
Viens et al.

(10) Patent No.: US 10,260,331 B2
(45) Date of Patent: Apr. 16, 2019

(54) AUTODRILLING CONTROL WITH ANNULUS PRESSURE MODIFICATION OF DIFFERENTIAL PRESSURE

(71) Applicant: Nabors Drilling Technologies USA, Inc., Houston, TX (US)

(72) Inventors: Christopher Viens, Houston, TX (US); Stephen Krase, Spring, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 100 days.

(21) Appl. No.: 15/342,467

(22) Filed: Nov. 3, 2016

(65) Prior Publication Data

US 2018/0119537 A1 May 3, 2018

(51) Int. Cl.

| | |
|---|---|
| ***E21B 21/08*** | (2006.01) |
| ***E21B 44/06*** | (2006.01) |
| ***E21B 47/06*** | (2012.01) |
| ***E21B 45/00*** | (2006.01) |
| ***E21B 47/01*** | (2012.01) |
| ***E21B 47/022*** | (2012.01) |
| ***E21B 19/16*** | (2006.01) |

(52) U.S. Cl.

CPC ..... *E21B 44/06* (2013.01); *E21B 19/16* (2013.01); *E21B 21/08* (2013.01); *E21B 45/00* (2013.01); *E21B 47/011* (2013.01); *E21B 47/022* (2013.01); *E21B 47/06* (2013.01)

(58) Field of Classification Search

CPC ..... E21B 47/06; E21B 21/08; E21B 44/00; E21B 34/10

USPC ..... 166/53, 250.15; 175/24, 48; 702/1, 9, 702/12, 47; 703/9, 10

See application file for complete search history.

(56) References Cited

U.S. PATENT DOCUMENTS

| | | | | |
|---|---|---|---|---|
| 9,765,583 | B2 * | 9/2017 | Rasmus | E21B 21/08 |
| 2007/0168056 | A1 * | 7/2007 | Shayegi | G05B 13/048 700/48 |
| 2008/0264690 | A1 * | 10/2008 | Khan | E21B 21/00 175/25 |
| 2011/0220410 | A1 * | 9/2011 | Aldred | E21B 44/00 175/26 |

(Continued)

*Primary Examiner* — John E Breene
*Assistant Examiner* — Jeffrey P Aiello
(74) *Attorney, Agent, or Firm* — Haynes and Boone, LLP

(57) ABSTRACT

A control system that corrects differential pressure measurements with downhole annulus pressure information is disclosed. When differential pressure is zeroed with the BHA off-bottom, the annulus pressure value is baselined. During drilling, a controller receives surface differential pressure measurements and annulus pressure measurements. As the controller receives each new annulus pressure measurement, it compares it to the baseline annulus pressure value to obtain a different annulus pressure value. The controller corrects the surface differential pressure measurements with the annulus pressure measurements. As the controller receives each new surface differential pressure measurement, it subtracts out the current difference annulus pressure value. As a result, the modified surface differential pressure measurement remains a reflection of mud motor performance that removes the influence of the increased density of the fluid, thereby improving autodrilling control. The modified surface differential pressure measurements are also used to determine mud motor torque.

20 Claims, 5 Drawing Sheets

(56) References Cited

U.S. PATENT DOCUMENTS

| | | | | |
|---|---|---|---|---|
| 2013/0173168 | A1* | 7/2013 | Abitrabi | G01V 9/00 702/13 |
| 2014/0284112 | A1* | 9/2014 | Cenac | E21B 21/10 175/317 |
| 2014/0365130 | A1* | 12/2014 | Woods | G01F 1/6884 702/12 |
| 2016/0017696 | A1* | 1/2016 | Srinivasan | E21B 44/00 703/10 |
| 2016/0115776 | A1* | 4/2016 | Haci | E21B 44/06 175/27 |
| 2017/0102092 | A1* | 4/2017 | Van de Ven | F16K 31/523 |

* cited by examiner

AUTODRILLING CONTROL WITH ANNULUS PRESSURE MODIFICATION OF DIFFERENTIAL PRESSURE

TECHNICAL FIELD

The present disclosure is directed to systems, devices, and methods for controlling a rate of penetration of a drill string in a wellbore. More specifically, the present disclosure is directed to systems, devices, and methods for modifying a differential pressure measurement with downhole annulus pressure information for improved rate of penetration and equipment wear.

BACKGROUND OF THE DISCLOSURE

Underground drilling involves drilling a bore through a formation deep in the Earth using a drill bit connected to a drill string. During drilling, an autodriller control system may be used to control the rate of penetration of the drill bit at the bottom hole assembly on the drill string. The rate of penetration may be based on a control parameter as a set point, such as weight on bit or surface differential pressure of the drilling fluid. For example, when measured surface differential pressure is used as a set point, the autodriller control system may reduce the weight on bit as measured surface differential pressure increases. Conversely, the autodriller control system may increase the weight on bit as the measured surface differential pressure decreases.

As the drill bit cuts into the surrounding formations in the wellbore, cuttings are produced. These cuttings mix with the drilling fluid (also referred to as drilling mud) in an annulus between the drill string and the sides of the wellbore. The drilling fluid transports these cuttings during circulation, eventually evacuating with the drilling fluid from the wellbore. However, as cuttings are added to the drilling fluid, this adds density to the drilling fluid, resulting in added pressure at the bottom of the wellbore at the bottom hole assembly. This is detected as an increase generally in the surface differential pressure that is attributed by existing control systems to increased pressure from the mud motor—but does not reflect an actual increase in mud motor torque.

As a result, present approaches respond by backing off one or more drilling parameters, such as weight on bit or block running speed, and therefore slowing the rate of penetration, in situations where it is not warranted by actual downhole conditions. The present disclosure is directed to systems, devices, and methods that overcome one or more of the shortcomings of the prior art.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
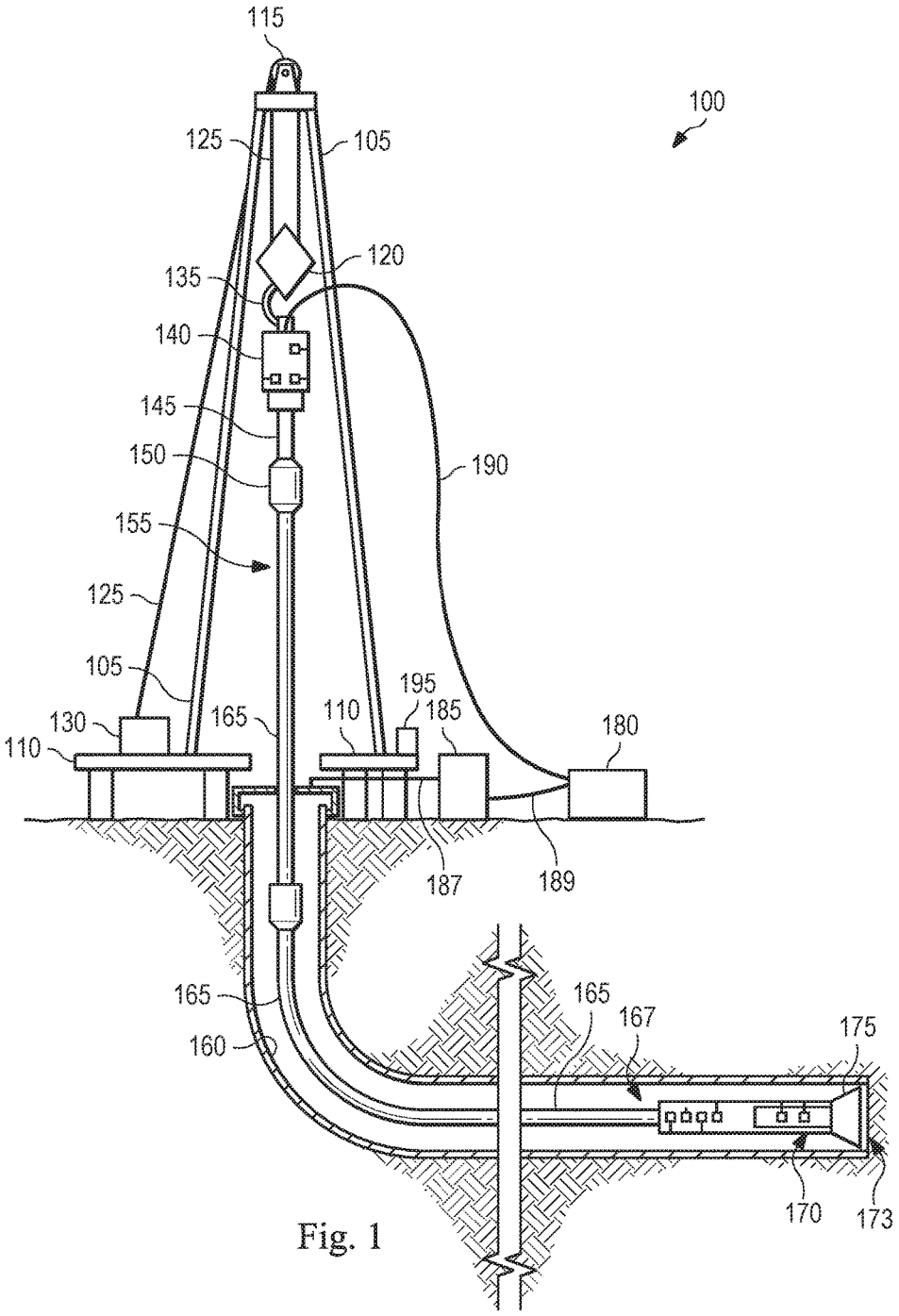
FIG. 1 is a schematic of an apparatus shown as an exemplary drilling rig according to one or more aspects of the present disclosure.

It is to be understood that the following disclosure provides many different embodiments, or examples, for implementing different features of various embodiments. Specific examples of components and arrangements are described below to simplify the present disclosure. These are merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Embodiments of the present disclosure include a drilling rig apparatus that includes a control system that modifies a differential pressure measurement with downhole annulus pressure information for improved rate of penetration and equipment wear.

In some implementations, when a controller zeros the surface differential pressure value as the bottom hole assembly is off-bottom in the wellbore prior to recommencing drilling, the controller may approximately concurrently baseline the existing annulus pressure measurement and store the baseline annulus pressure value in memory. As drilling thereafter commences, surface differential pressure measurements may be received at the controller according to a first frequency and annulus pressure measurements from a sensor at the bottom hole assembly may be received according to a second frequency, where the first frequency is different from the second frequency. For example, the first frequency may have a period of less than a second, such that multiple surface differential pressure measurements are received per second, while the second frequency may have a period of several seconds or longer. Thus, the annulus pressure measurements vary more slowly over time.

One of the reasons that the annulus pressure measurements may vary over time is that, as drilling continues, cuttings are added to the drilling fluid. This increases the density of the drilling fluid according to the weight and distribution of the cuttings in the fluid. The resulting surface differential pressure measurements reflect this increase in density as increases in pressure, though there is no corresponding increase in mud motor torque. Therefore, in autodrilling systems that use differential pressure (whether alone or in combination with weight on bit) as a set point to control rate of penetration, block running speed (and therefore weight on bit) may be unnecessarily reduced based on the increased density of the fluid.

Therefore, embodiments of the present disclosure modify the surface differential pressure measurements with the annulus pressure measurements. In some implementations, as each annulus pressure measurement is received, it is compared against the baseline annulus pressure value. The difference annulus pressure value is stored until the next annulus pressure measurement is received at the controller, at which point the new value is used. As the controller receives each new surface differential pressure measurement, it subtracts out the current difference annulus pressure value. As a result, the modified surface differential pressure measurement remains a reflection of mud motor performance with the influence of the increased density of the fluid removed.

Further, in some implementations the modified surface differential pressure measurements may be used in place of the unmodified surface differential pressure measurements in the MSE formula. This may provide a more accurate mud motor torque calculation for use in various operations.

Accordingly, embodiments of the present disclosure provide improvements in drilling time as a result of more accurately managing drilling parameters in autodriller systems, since the surface differential pressure measurements used to control the autodrilling aspects (whether alone or in combination with weight on bit as control parameter) may be modified by annulus pressure measurements received from the bottom hole assembly during drilling. This may safeguard against applying too much weight on bit in the event that annulus pressure decreases, while also maintaining the integrity of the surface differential pressure values used in calculating mud motor torque in an MSE calculation.

FIG. 1 is a schematic of a side view of an exemplary drilling rig 100 according to one or more aspects of the present disclosure. In some examples, the drilling rig 100 may form a part of a land-based, mobile drilling rig. However, one or more aspects of the present disclosure are applicable or readily adaptable to any type of drilling rig with supporting drilling elements, for example, the rig may include any of jack-up rigs, semisubmersibles, drill ships, coil tubing rigs, well service rigs adapted for drilling and/or re-entry operations, and casing drilling rigs, among others within the scope of the present disclosure.

The drilling rig 100 includes a mast 105 supporting lifting gear above a rig floor 110. The lifting gear may include a crown block 115 and a traveling block 120. The crown block 115 is coupled at or near the top of the mast 105, and the traveling block 120 hangs from the crown block 115 by a drilling line 125. One end of the drilling line 125 extends from the lifting gear to axial drive 130. In some implementations, axial drive 130 is a drawworks, which is configured to reel out and reel in the drilling line 125 to cause the traveling block 120 to be lowered and raised relative to the rig floor 110. The other end of the drilling line 125, known as a dead line anchor, is anchored to a fixed position, possibly near the axial drive 130 or elsewhere on the rig. Other types of hoisting/lowering mechanisms may be used as axial drive 130 (e.g., rack and pinion traveling blocks as just one example), though in the following reference will be made to drawworks 130 for ease of illustration.

A hook 135 is attached to the bottom of the traveling block 120. A drill string rotary device 140, of which a top drive is an example, is suspended from the hook 135. Reference will be made herein simply to top drive 140 for simplicity of discussion. A quill 145 extending from the top drive 140 is attached to a saver sub 150, which is attached to a drill string 155 suspended within a wellbore 160. Alternatively, the quill 145 may be attached to the drill string 155 directly. The term "quill" as used herein is not limited to a component which directly extends from the top drive 140, or which is otherwise conventionally referred to as a quill. For example, within the scope of the present disclosure, the "quill" may additionally or alternatively include a main shaft, a drive shaft, an output shaft, and/or another component which transfers torque, position, and/or rotation from the top drive or other rotary driving element to the drill string, at least indirectly. Nonetheless, for the sake of clarity and conciseness, these components may be collectively referred to herein as the "quill." It should be understood that other techniques for arranging a rig may not require a drilling line, and are included in the scope of this disclosure.

The drill string 155 includes interconnected sections of drill pipe 165, a bottom hole assembly (BHA) 170, and a drill bit 175 for drilling at bottom 173 of the wellbore 160. The BHA 170 may include stabilizers, drill collars, and/or measurement-while-drilling (MWD) or wireline conveyed instruments, among other components. The drill bit 175 is connected to the bottom of the BHA 170 or is otherwise attached to the drill string 155. In the exemplary embodiment depicted in FIG. 1, the top drive 140 is utilized to impart rotary motion to the drill string 155. However, aspects of the present disclosure are also applicable or readily adaptable to implementations utilizing other drive systems, such as a power swivel, a rotary table, a coiled tubing unit, a downhole motor, and/or a conventional rotary rig, among others.

A mud pump system 180 receives the drilling fluid, or mud, from a mud tank assembly 185 and delivers the mud to the drill string 155 through a hose or other conduit 190, which may be fluidically and/or actually connected to the top drive 140. In some implementations, the mud may have a density of at least 9 pounds per gallon. As more mud is pushed through the drill string 155, the mud flows through the drill bit 175 and fills the annulus 167 that is formed between the drill string 155 and the inside of the wellbore 160, and is pushed to the surface. At the surface the mud tank assembly 185 recovers the mud from the annulus 167 via a conduit 187 and separates out the cuttings (i.e., cuttings 308, see FIG. 3B). The mud tank assembly 185 may include a boiler, a mud mixer, a mud elevator, and mud storage tanks. After cleaning the mud, the mud is transferred from the mud tank assembly 185 to the mud pump system 180 via a conduit 189 or plurality of conduits 189. When the circulation of the mud is no longer needed, the mud pump system 180 may be removed from the drill site and transferred to another drill site.

The drilling rig 100 also includes a control system 195 configured to control or assist in the control of one or more components of the drilling rig 100. For example, the control system 195 may be configured to transmit operational control signals to the drawworks 130, the top drive 140, the BHA 170 and/or the mud pump system 180. The control system 195 may be a stand-alone component installed somewhere on or near the drilling rig 100, e.g. near the mast 105 and/or other components of the drilling rig 100, or on the rig floor to name just a few examples. In some embodiments, the control system 195 is physically displaced at a location separate and apart from the drilling rig, such as in a trailer in communication with the rest of the drilling rig. As used herein, terms such as "drilling rig" or "drilling rig apparatus" may include the control system 195 whether located at or remote from the remainder of the drilling rig.

According to embodiments of the present disclosure, the control system 195 may include, among other things, an autodriller control system configured to modify differential pressure measurements with annulus pressure measurements in order to improve drilling performance and equipment wear (which may also be referred to herein as correcting or compensating the differential pressure measurements with annulus pressure measurements).

For example, where cuttings accumulate in the annulus 167 during drilling fluid flow (before evacuation), they may contribute to the overall density of the drilling fluid in the wellbore 160. This is detected as an increase in surface differential pressure, though this does not in this situation reflect an actual increase in mud motor torque. Thus, modifying the surface differential pressure data with the annulus pressure data prior to controlling the block running speed addresses this problem so that the block running speed, and therefore weight on bit and rate of penetration, are not adjusted under false premises. Reference will be made herein to the control system 195 as an autodriller control system 195 for simplicity of discussion (though the control system generally may control other aspects, and/or the autodriller component may be integrated with or separate from those other aspects).

As an example, the autodriller control system 195 may receive multiple inputs, including surface differential pressure data, annulus pressure data, weight on bit data, block running speed data, and others from different sensing components of the drilling rig 100. The autodriller control system 195 uses the annulus pressure data to modify the surface differential pressure data it receives prior to using the differential pressure data (whether alone or in combination with other parameters such as weight on bit) to control the rate of penetration for the drilling rig 100, as will be discussed further below. To facilitate this use, the annulus pressure is recorded at the time that the surface differential pressure is zeroed/tared as the BHA 170 is off-bottom from bottom 173. Any changes in annulus pressure thereafter may be compared to the recorded annulus pressure, and that difference used to modify (e.g., correct) the surface differential pressure data.

In some embodiments, the surface differential pressure data is received at a higher frequency than the annulus pressure data, for example because of the additional time of traversal for the annulus pressure data from downhole at the BHA 170. Further, the nature of the factors contributing to annulus pressure, such as cuttings contributing to the density of the fluid, may take longer to change over time compared to the surface differential pressure data (i.e., the annulus pressure data may have a lower frequency response as compared to the surface differential pressure data). Thus, at any given time the same annulus pressure data may be used with one or more surface differential pressure data measurements before the annulus pressure data is updated with a new measurement from downhole. By providing any subsequent changes in drilling fluid density to be properly accounted for by the autodriller control system 195, a better rate of penetration and equipment wear may be achieved.

Figure 2:
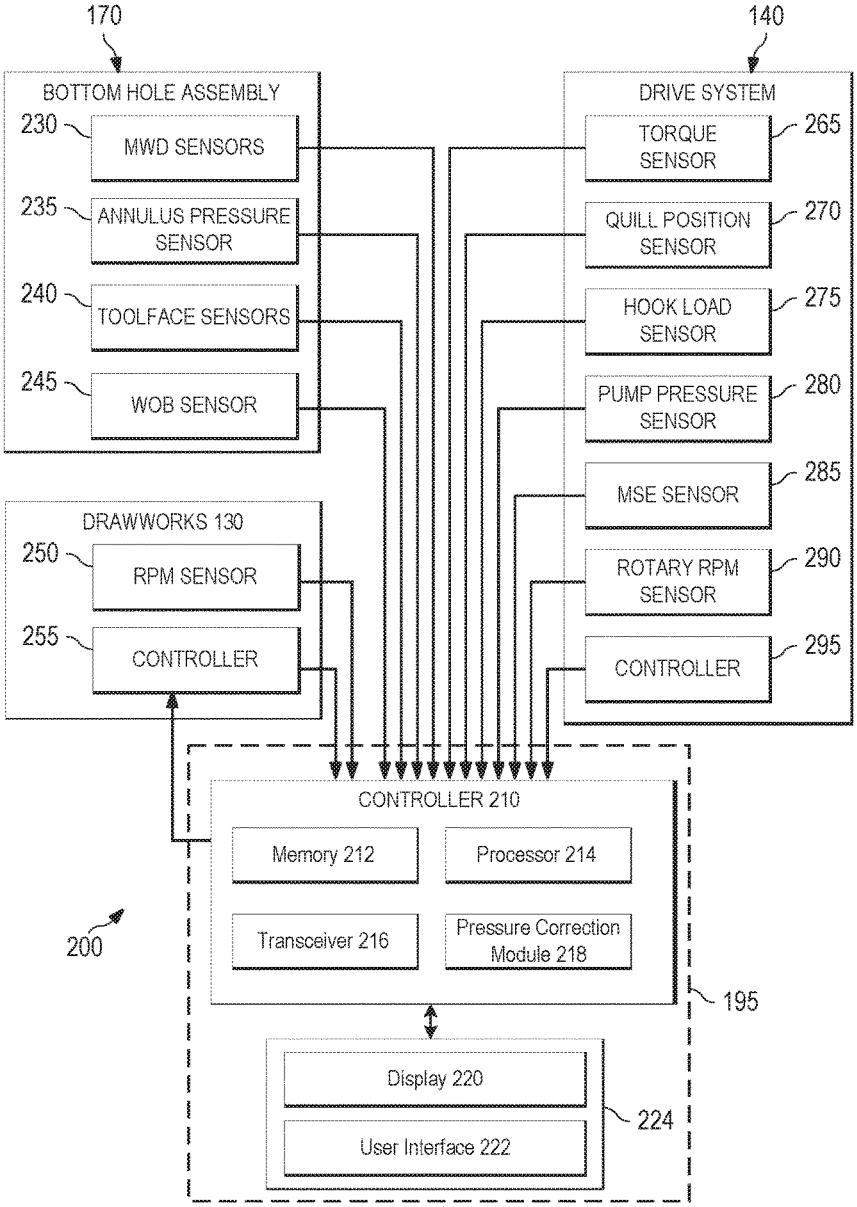
FIG. 2 is a block diagram of an apparatus shown as an exemplary control system according to one or more aspects of the present disclosure.

Turning to FIG. 2, a block diagram of an exemplary control system configuration 200 according to one or more aspects of the present disclosure is illustrated. In some implementations, the control system configuration 200 may be described with respect to the drawworks 130, top drive 140, BHA 170, and autodriller control system 195. The control system configuration 200 may be implemented within the environment and/or the apparatus shown in FIG. 1.

The autodriller control system 195 includes a controller 210 and may also include an interface system 224. Depending on the embodiment, these may be discrete components that are interconnected via wired and/or wireless means. Alternatively, the interface system 224 and the controller 210 may be integral components of a single system.

The controller 210 includes a memory 212, a processor 214, a transceiver 216, and a pressure correction module 218. The memory 212 may include a cache memory (e.g., a cache memory of the processor 214), random access memory (RAM), magnetoresistive RAM (MRAM), read-only memory (ROM), programmable read-only memory (PROM), erasable programmable read only memory (EPROM), electrically erasable programmable read only memory (EEPROM), flash memory, solid state memory device, hard disk drives, other forms of volatile and non-volatile memory, or a combination of different types of memory. In some embodiments, the memory 212 may include a non-transitory computer-readable medium.

The memory 212 may store instructions. The instructions may include instructions that, when executed by the processor 214, cause the processor 214 to perform operations described herein with reference to the controller 210 in connection with embodiments of the present disclosure. The terms "instructions" and "code" may include any type of computer-readable statement(s). For example, the terms "instructions" and "code" may refer to one or more programs, routines, sub-routines, functions, procedures, etc. "Instructions" and "code" may include a single computer-readable statement or many computer-readable statements.

The processor 214 may have various features as a specific-type processor. For example, these may include a central processing unit (CPU), a digital signal processor (DSP), an application-specific integrated circuit (ASIC), a controller, a field programmable gate array (FPGA) device, another hardware device, a firmware device, or any combination thereof configured to perform the operations described herein with reference to the autodriller control system 195 introduced in FIG. 1 above. The processor 214 may also be implemented as a combination of computing devices, e.g., a combination of a DSP and a microprocessor, a plurality of microprocessors, one or more microprocessors in conjunction with a DSP core, or any other such configuration. The transceiver 216 may include a local area network (LAN), wide area network (WAN), Internet, satellite-link, and/or radio interface to communicate bi-directionally with other devices, such as the top drive 140, drawworks 130, BHA 170, and other networked elements. For example, the transceiver 216 may include multiple ports corresponding to the different connections/access technologies used to communicate between components and locations (e.g., different ports for communication connections, as well as with different sensors that provide inputs into the controller 210 for autodrilling control, etc.).

The autodriller control system 195 may also include an interface system 224. The interface system 224 includes a display 220 and a user interface 222. The interface system 224 may also include a memory and a processor as described above with respect to controller 210. In some implementations, the interface system 224 is separate from the controller 210, while in other implementations the interface system 224 is part of the controller 210. Further, the interface system 224 may include a user interface 222 with a simplified display 220 or, in some embodiments, not include the display 220.

The display 220 may be used for visually presenting information to the user in textual, graphic, or video form. The display 220 may also be utilized by the user to input drilling parameters, limits, or set point data in conjunction with the input mechanism of the user interface 222, such as a set point for a desired differential pressure, weight on bit, etc. for use in autodrilling control according to embodiments of the present disclosure. The set point for the differential pressure (alone or also weight on bit where used as well) may be received before drilling begins and may be updated dynamically during drilling operations. For example, the input mechanism may be integral to or otherwise communicably coupled with the display 220. The input mechanism of the user interface 222 may also be used to input additional settings or parameters.

The input mechanism of the user interface 222 may include a keypad, voice-recognition apparatus, dial, button, switch, slide selector, toggle, joystick, mouse, data base and/or other conventional or future-developed data input device. Such a user interface 222 may support data input from local and/or remote locations. Alternatively, or additionally, the user interface 222 may permit user-selection of predetermined profiles, algorithms, set point values or ranges, and well plan profiles/data, such as via one or more drop-down menus. The data may also or alternatively be selected by the controller 210 via the execution of one or more database look-up procedures. In general, the user interface 222 and/or other components within the scope of the present disclosure support operation and/or monitoring from stations on the rig site as well as one or more remote locations with a communications link to the system, network, LAN, WAN, Internet, satellite-link, and/or radio, among other means.

The top drive 140 includes one or more sensors or detectors. The top drive 140 includes a rotary torque sensor 265 (also referred to herein as a torque sensor 265) that is configured to detect a value or range of the reactive torsion of the quill 145 or drill string 155. For example, the torque sensor 265 may be a torque sub physically located between the top drive 140 and the drill string 155. As another example, the torque sensor 265 may additionally or alternative be configured to detect a value or range of torque output by the top drive 140 (or commanded to be output by the top drive 140), and derive the torque at the drill string 155 based on that measurement. Detected voltage and/or current may be used to derive the torque at the interface of the drill string 155 and the top drive 140. The controller 295 is used to control the rotational position, speed and direction of the quill 145 or other drill string component coupled to the top drive 140 (such as the quill 145 shown in FIG. 1), shown in FIG. 2. The torque data may be sent via electronic signal or other signal to the controller 210 via wired and/or wireless transmission (e.g., to the transceiver 216).

The top drive 140 may also include a quill position sensor 270 that is configured to detect a value or range of the rotational position of the quill, such as relative to true north or another stationary reference. The top drive 140 may also include a hook load sensor 275 (e.g., that detects the load on the hook 135 as it suspends the top drive 140 and the drill string 155) and a rotary RPM sensor 290. The rotary RPM sensor 290 is configured to detect the rotary RPM of the drill string 155. This may be measured at the top drive or elsewhere, such as at surface portion of the drill string 155 (e.g., reading an encoder on the motor of the top drive 140). These signals, including the RPM detected by the RPM sensor 290, may be sent via electronic signal or other signal to the controller 210 via wired and/or wireless transmission.

The drive system represented by top drive 140 also includes a surface pump pressure sensor or gauge 280 (e.g., that detects the pressure of the pump providing mud or otherwise powering the down-hole motor in the BHA 170 from the surface) that will be referred to herein as a surface differential pressure (ΔP) sensor 280. The surface differential pressure sensor 280 is configured to detect a pressure differential value between the surface standpipe pressure while the BHA 170 is just off-bottom from bottom 173 and surface standpipe pressure once the bit of HBA 170 touches bottom 173 and starts drilling and experiencing torque (and generating cuttings). Typically, the surface differential pressure detected by the surface differential pressure sensor 280 represents how much pressure the mud motor at the BHA 170 is generating in the system, which is a function of mud motor torque.

The drive system represented by top drive 140 may also include a mechanical specific energy (MSE) sensor 285. The MSE sensor 285 may detect the MSE representing the amount of energy required per unit volume of drilled rock to remove it, whether directly sensed or calculated based on sensed data. For example, the MSE may be calculated based on sensed data including the surface differential pressure from the surface differential pressure sensor 280 and annulus pressure from the annulus pressure sensor 235. According to embodiments of the present disclosure, the surface differential pressure data from the surface differential pressure sensor 280 may be modified (e.g., corrected) by the annulus pressure data from the annulus pressure sensor 235 prior to use in a formula that calculates the MSE. This provides a more accurate MSE for use in various operations, made possible by embodiments of the present disclosure.

The drawworks 130 may include one or more sensors or detectors that provide information to the controller 210. The drawworks 130 may include an RPM sensor 250. The RPM sensor 250 is configured to detect the rotary RPM of the drilling line 125, which corresponds to the speed of hoisting/lowering of the drill string 155. This may be measured at the drawworks 130. The RPM detected by the RPM sensor 250 may be sent via electronic signal or other signal to the controller 210 via wired or wireless transmission. The drawworks 130 may also include a controller 255. The controller 255 is used to control the speed at which the drawstring is hoisted or lowered, for example as dictated by the autodriller control system 195 according to embodiments of the present disclosure.

In addition to the top drive 140 and drawworks 130, the BHA 170 may include one or more sensors, typically a plurality of sensors, located and configured about the BHA 170 to detect parameters relating to the drilling environment, the BHA 170 condition and orientation, and other information. The BHA 170 may include additional sensors/components beyond those illustrated in FIG. 2, which is simplified for purposes of illustration. The sensors/components may provide information that may be considered by the controller 210, for example the annulus pressure data used in correcting the surface differential pressure data before using the surface differential pressure data to control the block running speed.

In the embodiment shown in FIG. 2, the BHA 170 includes MWD sensors 230. For example, the MWD sensor 230 may include an MWD shock/vibration sensor that is configured to detect shock and/or vibration in the MWD portion of the BHA 170, and an MWD torque sensor that is configured to detect a value or range of values for torque applied to the bit by the motor(s) of the BHA 170. The MWD sensors 230 may also include an MWD RPM sensor that is configured to detect the RPM of the bit of the BHA 170. The data from these sensors may be sent via electronic signal or other signal to the controller 210 as well via wired and/or wireless transmission.

The BHA 170 may also include annulus pressure sensor 235 that is configured to detect an annular pressure value or range at the BHA 170, for example at or near the MWD portion of the BHA 170 (e.g., a casing pressure sensor). The data from annulus pressure sensor 235 may be sent via electronic signal or other signal to the controller 210 as well via wired and/or wireless transmission up to the surface for receipt, decoding, and use by the autodriller control system 195 in correcting the surface differential pressure data.

The BHA 170 may also include one or more toolface sensors 240, such as a magnetic toolface sensor and a gravity toolface sensor that are cooperatively configured to detect the current toolface orientation, such as relative to magnetic north. The gravity toolface may detect toolface orientation relative to the Earth's gravitational field. In an exemplary embodiment, the magnetic toolface sensor may detect the current toolface when the end of the wellbore is less than about 7° from vertical, and the gravity toolface sensor may detect the current toolface when the end of the wellbore is greater than about 7° from vertical. The BHA 170 may also include an MWD weight-on-bit (WOB) sensor 245 that is configured to detect a value or range of values for down-hole WOB at or near the BHA 170. The data from these sensors may be sent via electronic signal or other signal to the controller 210 via wired and/or wireless transmission.

Returning to the controller 210, the pressure correction module 218 may be used for various aspects of the present disclosure. The pressure correction module 218 may include various hardware components and/or software components to implement the aspects of the present disclosure. For example, in some implementations the pressure correction module 218 may include instructions stored in the memory 212 that causes the processor 214 to perform the operations described herein. In an alternative embodiment, the pressure correction module 218 is a hardware module that interacts with the other components of the controller 210 to perform the operations described herein.

As discussed above, the pressure correction module 218 is used to modify (e.g., correct) surface differential pressure data, such as when it is received, prior to use in maintaining the surface differential pressure at a set point value as part of the autodrilling control. The set point value may be entered as a target value by a user via the interface system 224; alternatively, a pre-populated value on display 220 may be selected from one or more options, including a default option.

The pressure correction module 218 may receive measured surface differential pressure data from the surface differential pressure sensor 280 as noted above. The pressure correction module 218 may further receive measured annulus pressure data from the annulus pressure sensor 235 as noted above. Prior to drilling operations commencing, when the BHA 170 is off-bottom (e.g., close to bottom 173), the controller 210 may zero/tare the surface differential pressure at the current value. Thus, for example, as the differential pressure is at a first value while the BHA 170 is off-bottom, the value is zeroed so that any new surface differential pressure data measurement is a difference from that zeroed value.

At approximately the same time that the surface differential pressure is zeroed, the controller 210 also records the annulus pressure measurement existing at the same time as a baseline annulus pressure. For example, the zeroing of the surface differential pressure triggers the recording of the annulus pressure measurement, whether occurring simultaneously with or a fraction of time after. This may occur every time that the surface differential pressure is zeroed and/or when the pumps are shut off.

After the zeroing/baselining occurs, drilling may commence. During drilling, both surface differential pressure data and annulus pressure data are repeatedly received. The surface differential pressure data may be received at a higher frequency than the annulus pressure data (i.e., the annulus pressure data may have a lower frequency response as compared to the surface differential pressure data), for example because of the additional time of traversal for the annulus pressure data from downhole at the BHA 170. For example, a new annulus pressure measurement may be received every 20-30 seconds (as just one example; some other time frame less than that of surface differential pressure measurement periodicity is also possible) while new surface differential pressure measurements may be received at some rate of multiple times per second (e.g., 50 to 100 Hz as just one example).

Since the nature of the factors contributing to annulus pressure, such as cuttings contributing to the density of the fluid, may take longer to change over time compared to the surface differential pressure data, this lower frequency response of the annulus pressure data is acceptable. Therefore, as an annulus pressure data measurement is received at the controller 210 via the transceiver 216, the processor 214 may cause the annulus pressure data to be stored in the memory 212 for reference/access with respect to surface differential pressure data measurements as they are also received at the transceiver 216.

Thus, at any given time the same annulus pressure data may be used in reference to the baseline annulus pressure with one or more surface differential pressure data measurements before the annulus pressure data is updated with a new measurement from downhole. As annulus pressure measurements are received, they may be compared against the baseline annulus pressure to determine difference annulus pressure values. For example, when a given annulus pressure value is received at the transceiver 216 from downhole, it is compared to the baseline annulus pressure maintained in the memory 212. The pressure correction module 218 may generate a difference between the two values—a difference annulus pressure value (which may also be referred to as a delta annulus pressure). This identifies any differences between what the baseline annulus pressure was at the time that the differential pressure was zeroed and what the current annulus pressure is. This may reflect changes in density in the drilling fluid that are unrelated to mud motor torque, such as may be caused by an increase in cuttings in the wellbore from drilling.

Continuing with the example of a given annulus pressure at a point in time, a new surface differential pressure value is received from the surface differential pressure sensor 280. The pressure correction module 218 compares the new surface differential pressure value with the difference annulus pressure value. In some embodiments, the pressure correction module 218 subtracts the difference annulus pressure value from the new surface differential pressure value to arrive at a modified (e.g., corrected) surface differential pressure value. This corrected surface differential pressure value is then used by the autodriller control system 195 in comparison to a set point surface differential pressure value (or other value derivable/influenced by the surface differential pressure value) to maintain the surface differential pressure at the set point value as part of the autodrilling control (increasing or decreasing block running speed, for example, to arrive at the desired set point value when measured, alone or in combination with using weight on bit as a set point as well according to various embodiments).

For example, if the annulus pressure has increased from the baseline annulus pressure, then subtracting the amount of the difference annulus pressure value from the new surface differential pressure value reduces the resulting corrected surface differential pressure value. Therefore, the autodriller control system 195 does not react as strongly to the new surface differential pressure value in controlling the block running speed (and therefore weight on bit/rate of penetration) when using the corrected differential surface differential pressure value as would otherwise occur. This minimizes rate of penetration loss as the autodriller control system 195 operates more efficiently by, in effect, filtering out contaminating signals from the surface differential pressure measurement.

As another example, if the annulus pressure has decreased from the baseline annulus pressure (e.g., taking on gas or some lighter fluid in the wellbore that decreases the fluid density), then subtracting the amount of the difference annulus pressure from the new surface differential pressure value increases the resulting corrected surface differential pressure value. Therefore, the autodriller control system 195 reacts by reducing the block running speed, and therefore weight on bit, to bring the surface differential pressure value back down to the set point target level. This minimizes unnecessary wear on the drill bit and the risk of damage to any surrounding formations in the wellbore during drilling.

The above example is with respect to a single surface differential pressure value; the same procedure may repeat multiple times a second (e.g., 50-100 times a second depending on the frequency of the samples of the surface differential pressure values taken by the surface differential pressure sensor 280). Further, the same difference annulus pressure value, for example stored in the memory 212, may be used for many surface differential pressure values until a next annulus pressure measurement is received from the annulus pressure sensor 235 downhole, at which time the difference annulus pressure value is updated and used to generate corrected surface differential pressure values.

With the corrected surface differential pressure values, in addition to better controlling the rate of penetration for better bit wear and rate of penetration efficiencies, the MSE calculated may be more accurate as it uses the corrected surface differential pressure values, instead of uncorrected surface differential pressure values, as inputs into its formula.

The above procedure may repeat over the course of drilling unless/until some change event occurs. For example, if the BHA 170 is taken off-bottom again and the surface differential pressure re-zeroed, then the annulus pressure will be baselined again at that time of re-zeroing. Thus, whenever drilling commences, the concentration of the drilling fluid downhole is taken into account, and thereafter as cuttings are added to the mud column the above procedure filters out the density changes to obtain more accurate values for the surface differential pressure. Thus, the annulus pressure from downhole measurements is used according to embodiments of the present disclosure to adjust the autodriller control system 195.

FIG. 2 illustrates the controller 210 as being the only controller in the control system 195. The control system 195 may include other controllers for other control aspects of the drilling rig 100, which may be alternatively be integrated with the controller 210 or be separate therefrom.

Figure 3A:
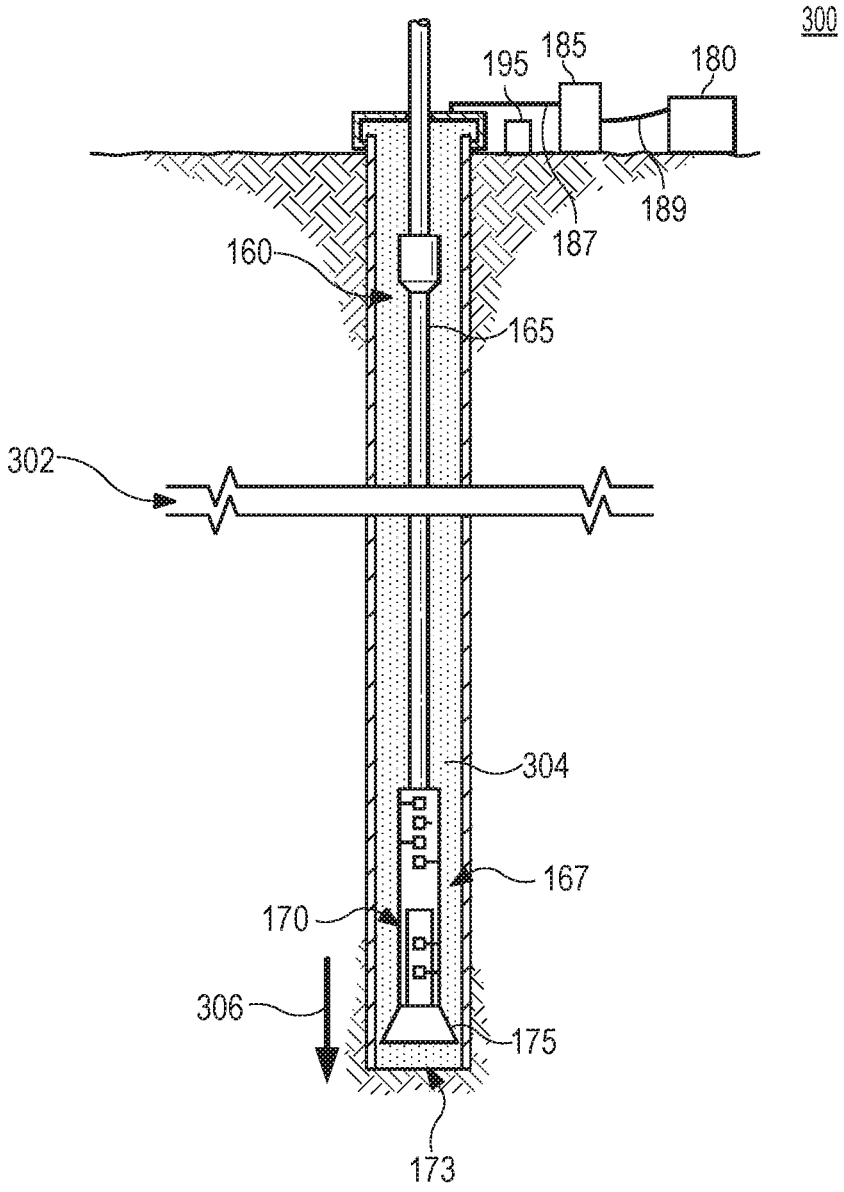
FIG. 3A is a cross-section view of an exemplary wellbore environment prior to commencing drilling according to one or more aspects of the present disclosure.

FIG. 3A is a cross-section view of an exemplary wellbore environment 300 prior to commencing drilling according to one or more aspects of the present disclosure. Common elements to those introduced previously have the same reference numbers for ease of identification.

As illustrated, the BHA 170 is downhole and off-bottom from the bottom 173 (the cutaway 302 illustrating that the depth may be any amount). At this point, drilling 306 has not yet recommenced. Drilling fluid 304 may be in a state of equilibrium in the mud column in FIG. 3A (i.e., filling the annulus 167), for example in response to circulation of the drilling fluid 304 evacuating a substantial amount of prior cuttings from the wellbore. As discussed above, at this point the surface differential pressure may be zeroed, and concurrently therewith the existing annulus pressure recorded as the baseline annulus pressure. Drilling 306 may thereafter commence.

Figure 3B:
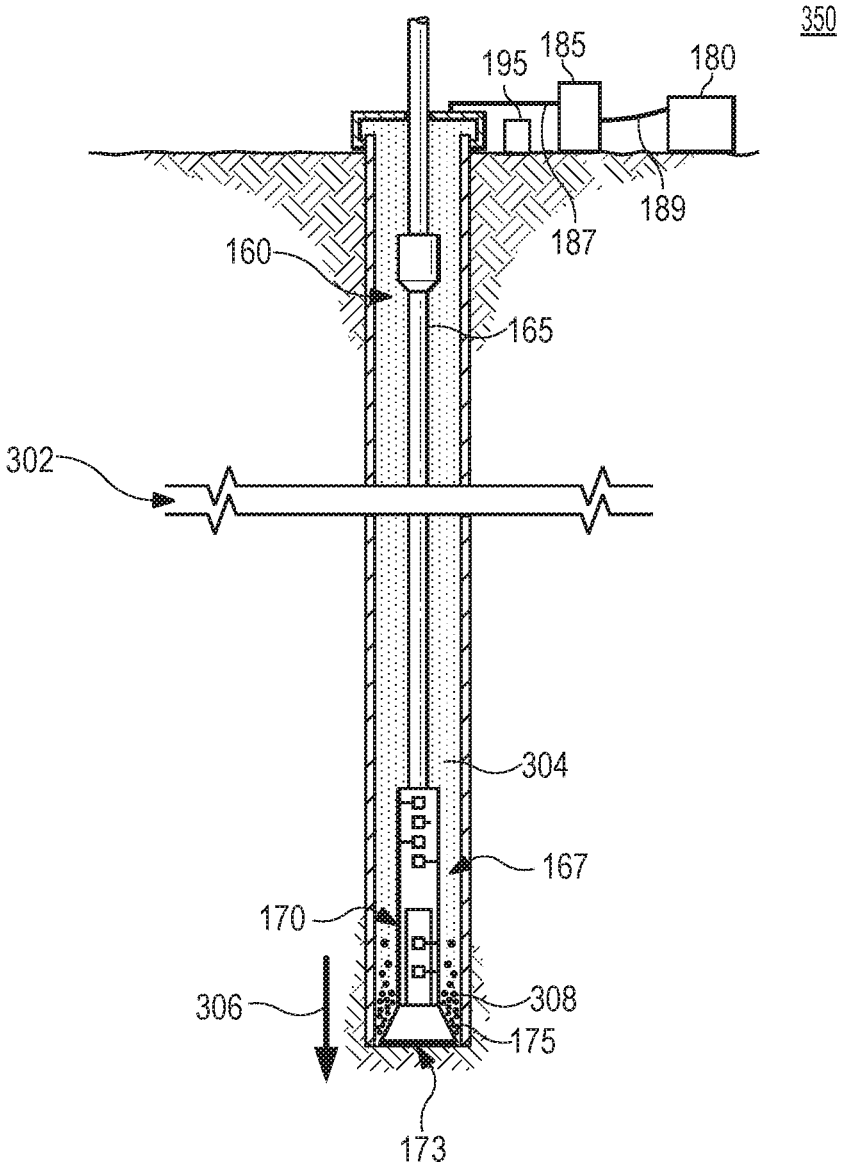
FIG. 3B is a cross-section view of an exemplary wellbore environment after commencing drilling according to one or more aspects of the present disclosure.

This is considered in FIG. 3B, which is a cross-section view of an exemplary wellbore environment 350 after commencing drilling according to one or more aspects of the present disclosure. As drilling 306 gets underway, cuttings 308 begin mixing with the drilling fluid 304 as it circulates through the annulus 167. The cuttings 308 mixing into the drilling fluid 304 begins to modify the density of the drilling fluid 304, which is detected by the surface differential pressure sensor 280. However, as noted above, in this situation it is not a reflection of actual changes in mud motor torque. Thus, the annulus pressure measurements are used to modify (e.g., correct) the surface differential pressure measurements so that the change in density caused by the cuttings 308 is taken into account and filtered out from the perspective of the autodrilling control.

Figure 4:
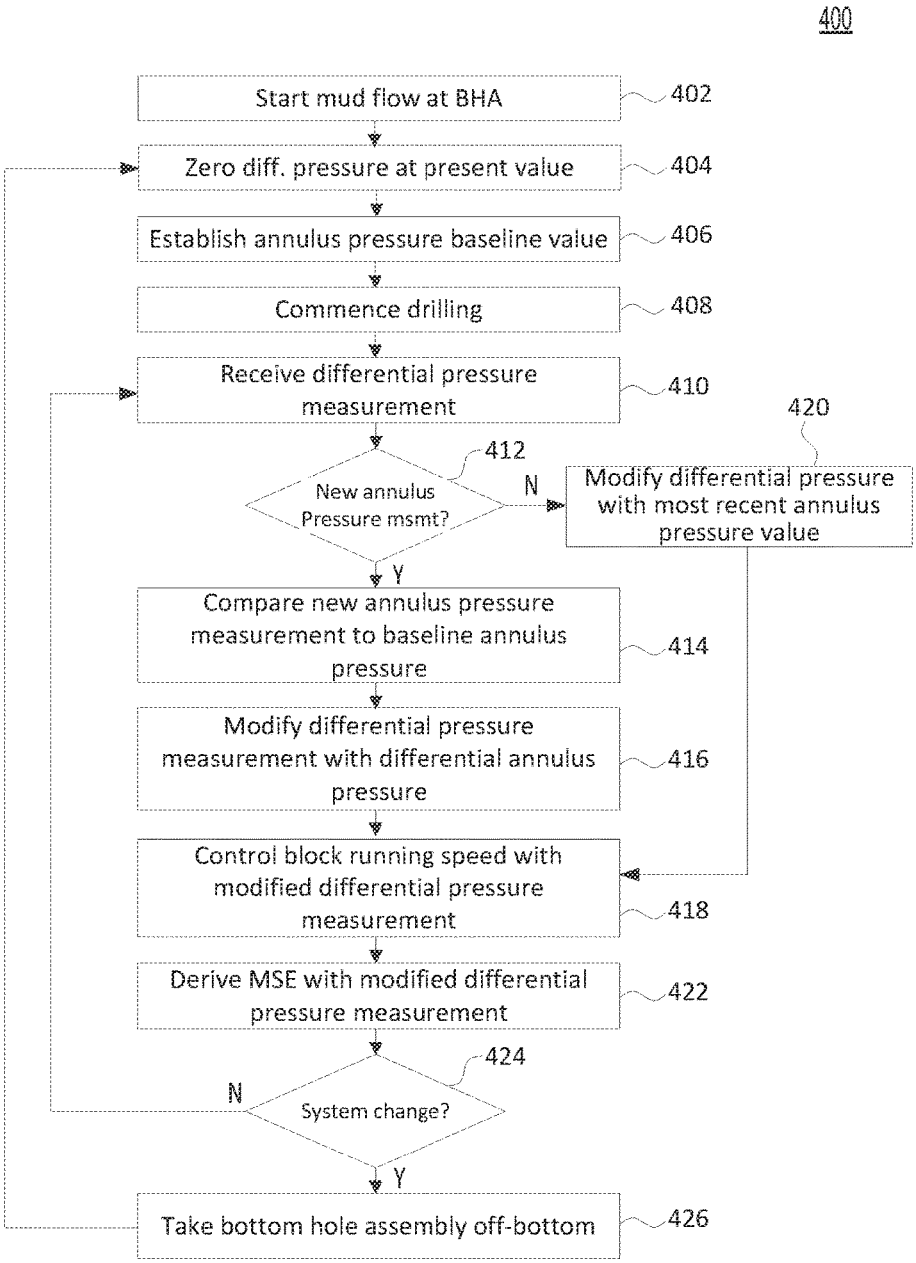
FIG. 4 is a flow chart showing an exemplary process for correcting differential pressure with annulus pressure according to aspects of the present disclosure.

Turning now to FIG. 4, an exemplary flow chart showing an exemplary method 400 for modifying (e.g., correcting) differential pressure with annulus pressure according to aspects of the present disclosure is illustrated. The method 400 may be performed, for example, with respect to the autodriller control system 195 and the drilling rig 100 components discussed above with respect to FIGS. 1, 2, 3A, and 3B. For purposes of discussion, reference in FIG. 4 will be made to controller 210 of FIG. 2, though it will be recognized that the same may be achieved generally by the autodriller control system 195 of FIG. 2. It is understood that additional steps can be provided before, during, and after the steps of method 400, and that some of the steps described can be replaced or eliminated from the method 400.

At block 402, after the drill string has been inserted downhole until the BHA 170 is just off-bottom from the bottom 173, the drilling fluid flow (mud flow) may begin. This may alternatively begin at some prior time during tripping of the drill string. Alternatively, the BHA 170 may have not tripped the wellbore, but rather been moved off-bottom a small amount (less than a distance sufficient to remove the BHA 170 from the wellbore).

At block 404, the controller 210 zeroes the surface differential pressure at its then-current value, as the BHA 170 is still off-bottom.

At block 406, the controller 210 establishes a baseline annulus pressure value based on the then-current annulus pressure value. This is done approximately concurrently with the zeroing of the surface differential pressure, as a result of the action at block 404.

At block 408, the drilling at bottom 173 of the wellbore commences.

At block 410, while drilling is underway, the controller 210 (e.g., via transceiver 216) receives a surface differential pressure measurement from the surface differential pressure sensor 280.

At decision block 412, if the controller 210 has also received a new annulus pressure measurement from the annulus pressure sensor 235, then the method 400 proceeds to block 414.

At block 414, the controller 210 compares the new annulus pressure measurement to the baseline annulus pressure value. For example, the difference between the two is measured and a difference annulus pressure value is obtained.

At block 416, the difference annulus pressure value is compared to the surface differential pressure measurement from block 410. In some embodiments, the difference annulus pressure value is subtracted from the surface differential pressure measurement. The resulting value is a modified value for the differential pressure, referred to with respect to FIG. 2 as a corrected surface differential pressure value.

At block 418, the controller 210 controls the rate of penetration using the modified differential pressure measurement. This is done by comparing the modified differential pressure measurement with the set point value for the autodriller control (alone or in combination with weight on bit as another set point in embodiments). If the modified differential pressure measurement is above the set point, then the block running speed is reduced, thereby reducing weight on bit, surface differential pressure, and rate of penetration. If the modified differential pressure measurement is below the set point, then the block running speed may be increased, thereby increasing weight on bit, surface differential pressure, and rate of penetration. If the modified differential pressure measurement is equal to the set point, then operation continues with the then-existing parameters.

Returning to decision block 412, if the controller 210 has not also received a new annulus pressure measurement, then the method 400 proceeds instead to block 420. This occurs, for example, because the surface differential pressure has a higher frequency of sampling as compared to that of the annulus pressure.

At block 420, the controller 210 modifies the surface differential pressure measurement by comparing the previously stored annulus pressure value (e.g., the most recent annulus pressure measurement received from the annulus pressure sensor 235, stored in memory 212 as a difference value from the baseline annulus pressure value) to the surface differential pressure measurement from block 410. In some embodiments, the difference annulus pressure value is subtracted from the surface differential pressure measurement. The resulting value is the modified differential pressure measurement (also referred to as the corrected differential pressure measurement herein). The method 400 proceeds from block 420 to block 418 as discussed above with respect to controlling the rate of penetration.

From block 418, the method 400 proceeds to block 422. At block 422, the controller 210, or the MSE sensor 285, derives the MSE using the modified differential pressure measurement obtained from block 416 or 420.

At decision block 424, if no system change has occurred yet (e.g., the mud pump system 180 is shut off, or the flow rate for the drilling fluid is changing, etc.), then the method 400 returns to the block 410 as another surface differential pressure measurement is received (which may occur multiple times a second, e.g. dozens or hundreds of times as just some examples) and proceeds as discussed above and further below.

If, instead, a system change has occurred, then the method 400 proceeds to block 426. At block 426, the BHA 170 is taken off-bottom so that the values can be re-zeroed/baselined.

To that effect, the method 400 proceeds from block 426 back to block 404 for re-zeroing/baselining and the remaining aspects of method 400 as discussed above. This may continue as long as drilling is underway.

Accordingly, embodiments of the present disclosure provide a reduction in drilling time as a result of more accurately managing drilling parameters in the autodriller control system 195, since the surface differential pressure measurements used to control the autodrilling aspects are modified (e.g., corrected) by any annulus pressure measurements received from the annulus pressure sensor 235 downhole at the BHA 170. This may safeguard against applying too much weight on bit in the event that annulus pressure decreases, while also maintaining the integrity of the surface differential pressure values used in calculating mud motor torque in an MSE calculation.

In view of the above and the figures, one of ordinary skill in the art will readily recognize that the present disclosure introduces an apparatus comprising: a transceiver configured to receive a differential pressure measurement of a mud flow in a drilling rig from a differential pressure sensor; and receive an annulus pressure measurement of pressure in a vicinity to a bottom hole assembly of the drilling rig from an annulus pressure sensor; and a controller configured to receive the differential pressure measurement and the annulus pressure measurement from the transceiver; modify the differential pressure measurement with the annulus pressure measurement; and control a rate of penetration of the bottom hole assembly with the modified differential pressure measurement.

The apparatus may include wherein the controller is further configured to: establish a baseline annulus pressure from a concurrent annulus pressure measurement taken by the annulus pressure sensor at approximately a same time as differential pressure is zeroed with the bottom hole assembly off-bottom. The apparatus may also include wherein the controller is further configured to: subtract the annulus pressure measurement from the baseline annulus pressure to obtain a delta annulus pressure measurement; and modify the differential pressure measurement with the delta annulus pressure measurement to obtain the modified differential pressure measurement. The apparatus may also include wherein the controller is further configured to subtract the annulus pressure measurement from the differential pressure measurement to obtain the modified differential pressure measurement. The apparatus may also include wherein the apparatus comprises an autodriller. The apparatus may also include wherein the first data input port receives differential pressure measurements at a first frequency, the second data input port receives annulus pressure measurements at a second frequency, and the first frequency is different from (e.g., greater than) the second frequency. The apparatus may also include wherein the controller is further configured to: re-establish a baseline annulus pressure from a current annulus pressure measurement in response to the bottom hole assembly coming off-bottom and differential pressure being re-zeroed.

The present disclosure also includes a method, comprising: receiving, at a controller of a drilling rig from a differential pressure sensor, a differential pressure measurement of a mud flow in the drilling rig; receiving, at the controller from an annulus pressure sensor, an annulus pressure measurement from fluid in a vicinity to a bottom hole assembly of the drilling rig; modifying, by the controller, the differential pressure measurement with the annulus pressure measurement; and controlling, by the controller, a rate of penetration of the bottom hole assembly with the modified differential pressure measurement.

The method may include zeroing, by the controller, a differential pressure as the bottom hole assembly is off-bottom prior to commencing drilling operations; and establishing, by the controller in response to the zeroing, a baseline annulus pressure from a concurrent annulus pressure measurement taken by the annulus pressure sensor. The method may also include wherein the modifying further comprises: subtracting, by the controller, the annulus pressure measurement from the baseline annulus pressure to obtain a delta annulus pressure measurement; and modifying, by the controller, the differential pressure measurement with the delta annulus pressure measurement to obtain the modified differential pressure measurement. The method may also include wherein the modifying further comprises: subtracting, by the controller, the annulus pressure measurement from the differential pressure measurement to obtain the modified differential pressure measurement. The method may also include wherein: the receiving the differential pressure measurement comprises receiving the differential pressure measurement at a first frequency, the receiving the annulus pressure measurement comprises receiving the annulus pressure measurement at a second frequency, and the first frequency is greater than the second frequency. The method may also include re-zeroing, by the controller, a differential pressure against which the differential pressure measurement is compared in response to the bottom hole assembly coming off-bottom; and re-establishing, by the controller in response to the re-zeroing, a baseline annulus pressure. The method may also include deriving, by the controller, a mechanical specific energy value based on the modified differential pressure measurement.

The present disclosure also introduces a non-transitory machine-readable medium having stored thereon machine-readable instructions executable to cause a machine to perform operations comprising: receiving a differential pressure measurement of a mud flow in a drilling rig from a differential pressure sensor; modifying the differential pressure measurement with an annulus pressure measurement of pressure in a vicinity to a bottom hole assembly of the drilling rig received from an annulus pressure sensor; and controlling a rate of penetration of the bottom hole assembly into a subterranean formation with the modified differential pressure measurement.

The non-transitory machine-readable medium may include wherein the annulus pressure measurement comprises a first annulus pressure measurement, the operations further comprising: receiving a first plurality of differential pressure measurements including the differential pressure measurement; and modifying the first plurality of differential pressure measurements with the first annulus pressure measurement. The non-transitory machine-readable medium may also include operations comprising: receiving a second annulus pressure measurement from the annulus pressure sensor; receiving a second plurality of differential pressure measurements after the first plurality of differential pressure measurements; and modifying the second plurality of differential pressure measurements with the second annulus pressure measurement. The non-transitory machine-readable medium may also include operations comprising: zeroing a differential pressure as the bottom hole assembly is off-bottom prior to commencing drilling operations; and establishing, in response to the zeroing, a baseline annulus pressure from a annulus pressure measurement concurrent to the zeroing taken by the annulus pressure sensor. The non-transitory machine-readable medium may also include wherein the modifying further includes operations comprising: subtracting the annulus pressure measurement from the baseline annulus pressure to obtain a delta annulus pressure measurement; and modifying the differential pressure measurement with the delta annulus pressure measurement to obtain the modified differential pressure measurement. The non-transitory machine-readable medium may also include wherein the modifying further includes operations comprising: subtracting the annulus pressure measurement from the differential pressure measurement to obtain the modified differential pressure measurement.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. § 112(f) for any limitations of any of the claims herein, except for those in which the claim expressly uses the word "means" together with an associated function.

What is claimed is:

1. An apparatus, comprising:

a transceiver configured to:

receive a differential pressure measurement of a mud flow in a drilling rig from a differential pressure sensor; and receive an annulus pressure measurement of pressure in a vicinity to a bottom hole assembly of the drilling rig from an annulus pressure sensor; and a controller configured to:

receive the differential pressure measurement and the annulus pressure measurement from the transceiver;

modify the differential pressure measurement with the annulus pressure measurement; and control a rate of penetration of the bottom hole assembly with the modified differential pressure measurement.

2. The apparatus of claim 1, wherein the controller is further configured to:

establish a baseline annulus pressure from a concurrent annulus pressure measurement taken by the annulus pressure sensor at approximately a same time as differential pressure is zeroed with the bottom hole assembly off-bottom.

3. The apparatus of claim 2, wherein the controller is further configured to:

subtract the annulus pressure measurement from the baseline annulus pressure to obtain a delta annulus pressure measurement; and modify the differential pressure measurement with the delta annulus pressure measurement to obtain the modified differential pressure measurement.

4. The apparatus of claim 1, wherein the controller is further configured to subtract the annulus pressure measurement from the differential pressure measurement to obtain the modified differential pressure measurement.

5. The apparatus of claim 1, wherein the apparatus comprises an autodriller.

6. The apparatus of claim 1, wherein:

the transceiver receives differential pressure measurements at a first frequency, the transceiver receives annulus pressure measurements at a second frequency, and the first frequency is greater than the second frequency.

7. The apparatus of claim 1, wherein the controller is further configured to:

re-establish a baseline annulus pressure from a current annulus pressure measurement in response to the bottom hole assembly coming off-bottom and differential pressure being re-zeroed.

8. A method, comprising:

receiving, at a controller of a drilling rig from a differential pressure sensor, a differential pressure measurement of a mud flow in the drilling rig;

receiving, at the controller from an annulus pressure sensor, an annulus pressure measurement from fluid in a vicinity to a bottom hole assembly of the drilling rig;

modifying, by the controller, the differential pressure measurement with the annulus pressure measurement; and controlling, by the controller, a rate of penetration of the bottom hole assembly with the modified differential pressure measurement.

9. The method of claim 8, further comprising:

zeroing, by the controller, a differential pressure as the bottom hole assembly is off-bottom prior to commencing drilling operations; and establishing, by the controller in response to the zeroing, a baseline annulus pressure from a concurrent annulus pressure measurement taken by the annulus pressure sensor.

10. The method of claim 9, wherein the modifying further comprises:

subtracting, by the controller, the annulus pressure measurement from the baseline annulus pressure to obtain a delta annulus pressure measurement; and modifying, by the controller, the differential pressure measurement with the delta annulus pressure measurement to obtain the modified differential pressure measurement.

11. The method of claim 8, wherein the modifying further comprises:

subtracting, by the controller, the annulus pressure measurement from the differential pressure measurement to obtain the modified differential pressure measurement.

12. The method of claim 8, wherein:

the receiving the differential pressure measurement comprises receiving the differential pressure measurement at a first frequency, the receiving the annulus pressure measurement comprises receiving the annulus pressure measurement at a second frequency, and the first frequency is greater than the second frequency.

13. The method of claim 8, further comprising:

re-zeroing, by the controller, a differential pressure against which the differential pressure measurement is compared in response to the bottom hole assembly coming off-bottom; and re-establishing, by the controller in response to the re-zeroing, a baseline annulus pressure.

14. The method of claim 8, further comprising:

deriving, by the controller, a mechanical specific energy value based on the modified differential pressure measurement.

15. A non-transitory machine-readable medium having stored thereon machine-readable instructions executable to cause a machine to perform operations comprising:

receiving a differential pressure measurement of a mud flow in a drilling rig from a differential pressure sensor;

modifying the differential pressure measurement with an annulus pressure measurement of pressure in a vicinity to a bottom hole assembly of the drilling rig received from an annulus pressure sensor; and controlling a rate of penetration of the bottom hole assembly into a subterranean formation with the modified differential pressure measurement.

16. The non-transitory machine-readable medium of claim 15, wherein the annulus pressure measurement comprises a first annulus pressure measurement, the operations further comprising:

receiving a first plurality of differential pressure measurements including the differential pressure measurement; and modifying the first plurality of differential pressure measurements with the first annulus pressure measurement.

17. The non-transitory machine-readable medium of claim 16, the operations further comprising:

receiving a second annulus pressure measurement from the annulus pressure sensor;

receiving a second plurality of differential pressure measurements after the first plurality of differential pressure measurements; and modifying the second plurality of differential pressure measurements with the second annulus pressure measurement.

18. The non-transitory machine-readable medium of claim 15, the operations further comprising:

zeroing a differential pressure as the bottom hole assembly is off-bottom prior to commencing drilling operations; and establishing, in response to the zeroing, a baseline annulus pressure from a annulus pressure measurement concurrent to the zeroing taken by the annulus pressure sensor.

19. The non-transitory machine-readable medium of claim 18, wherein the modifying further includes operations comprising:

subtracting the annulus pressure measurement from the baseline annulus pressure to obtain a delta annulus pressure measurement; and modifying the differential pressure measurement with the delta annulus pressure measurement to obtain the modified differential pressure measurement.

20. The non-transitory machine-readable medium of claim 15, wherein the modifying further includes operations comprising:

subtracting the annulus pressure measurement from the differential pressure measurement to obtain the modified differential pressure measurement.

* * * * *